US008314674B2

(12) United States Patent
Hamberger et al.

(10) Patent No.: US 8,314,674 B2
(45) Date of Patent: Nov. 20, 2012

(54) ELECTRICAL TRANSFORMER WITH UNIDIRECTIONAL FLUX COMPENSATION

(75) Inventors: Peter Hamberger, Kirchschlag (AT); Albert Leikermoser, Salzburg (AT)

(73) Assignee: Siemens AG Österreich, Vienna (AT)

( * ) Notice: Subject to any disclaimer, the term of this patent is extended or adjusted under 35 U.S.C. 154(b) by 409 days.

(21) Appl. No.: 12/663,710

(22) PCT Filed: Jun. 12, 2007

(86) PCT No.: PCT/EP2007/055728

§ 371 (c)(1),
(2), (4) Date: Dec. 9, 2009

(87) PCT Pub. No.: WO2008/151661

PCT Pub. Date: Dec. 18, 2008

(65) Prior Publication Data

US 2010/0194373 A1 Aug. 5, 2010

(51) Int. Cl.
*H01F 27/28* (2006.01)
*H01F 27/42* (2006.01)

(52) U.S. Cl. ..... 336/170; 336/183; 323/356

(58) Field of Classification Search ..... 336/170, 336/183; 323/355, 356
See application file for complete search history.

(56) References Cited

U.S. PATENT DOCUMENTS

| | | | | |
|---|---|---|---|---|
| 1,412,782 | A | 4/1922 | Dwyer | |
| 2,297,672 | A * | 9/1942 | Stevens | 323/307 |
| 2,297,673 | A * | 9/1942 | Stevens | 323/302 |
| 2,617,973 | A * | 11/1952 | Wolff, Jr. et al. | 363/93 |
| 2,761,097 | A * | 8/1956 | Le Tourneau | 318/148 |
| 2,895,103 | A * | 7/1959 | Vogt et al. | 324/260 |
| 3,140,439 | A * | 7/1964 | Weil | 323/251 |
| 3,398,292 | A * | 8/1968 | Kuba | 307/51 |
| 3,546,565 | A * | 12/1970 | Koll et al. | 323/309 |
| 3,688,301 | A * | 8/1972 | Suzuki et al. | 341/149 |
| 4,339,706 | A * | 7/1982 | Kusko | 323/248 |
| 4,346,340 | A | 8/1982 | Hackett-Jones | |
| 4,602,212 | A * | 7/1986 | Hiroshima et al. | 324/227 |
| 4,975,649 | A * | 12/1990 | Bobry | 324/547 |
| 5,225,784 | A * | 7/1993 | So | 324/657 |

(Continued)

FOREIGN PATENT DOCUMENTS

DE 19854902 A1 2/2000

(Continued)

OTHER PUBLICATIONS

Ghalayini et al., "Mitigating GIC Saturation in Power Transformers", Journal of the Magnetic Society of Japan, Tokyo, Department of Electrical and Computer Engineering, University of Toronto, Canada, Ontario Hydro Technologies, Toronto, Ontario Canada, Department of Electrical an Computer Engineering, Kanazawa University, Japan; Magazine; 1995; JP vol. 19, No. 2.

(Continued)

*Primary Examiner* — Mohamad Musleh
*Assistant Examiner* — Joselito Baisa

(57) ABSTRACT

An electrical transformer with unidirectional flux compensation is provided. The transformer includes a soft magnetic core on which a primary winding arrangement, a secondary winding arrangement, and a compensation winding arrangement are arranged. The compensation winding arrangement is connected to a current control device which feeds a compensation current into the compensation winding arrangement using a control signal. A magnetic field measuring device measures the magnetic field in the core of the transformer or the stray magnetic field that closes outside the core via an air path and provides the control signal.

4 Claims, 7 Drawing Sheets

U.S. PATENT DOCUMENTS

| | | | | |
|---|---|---|---|---|
| 5,416,458 | A * | 5/1995 | Menke et al. | 336/12 |
| 5,726,617 | A | 3/1998 | Pla et al. | |
| 5,912,553 | A * | 6/1999 | Mengelkoch | 323/309 |
| 6,073,493 | A * | 6/2000 | Sakamoto et al. | 73/801 |
| 7,489,485 | B2 * | 2/2009 | A F Klercker Alakula et al. | 361/35 |
| 2008/0001694 | A1 * | 1/2008 | Wang | 336/84 R |

FOREIGN PATENT DOCUMENTS

| | | | |
|---|---|---|---|
| DE | 69901596 | T2 | 10/2000 |
| EP | 0309255 | A1 | 3/1989 |
| GB | 2013000 | A | 8/1979 |
| JP | 59013313 | A | 1/1984 |
| RU | 2343623 | C1 | 1/2009 |

OTHER PUBLICATIONS

Lenk J., "Electronic circuitry: Practical manual", Moscow, 1985, p. 148-149, Fig. 15, 13a, b); Others.

* cited by examiner

ELECTRICAL TRANSFORMER WITH UNIDIRECTIONAL FLUX COMPENSATION

CROSS REFERENCE TO RELATED APPLICATIONS

This application is the US National Stage of International Application No. PCT/EP2007/055728, filed Jun. 12, 2007 and claims the benefit thereof.

TECHNICAL FIELD

The invention relates to an electrical transformer with unidirectional flux compensation.

PRIOR ART

It is known that in the case of an electrical transformer operated in conjunction with a converter, a current component that superimposes itself on the operating current of the transformer can arise owing to inaccuracies in driving the power semiconductor switches. Said current component, which can in terms of the power supply system be regarded as direct current, will be referred to below also as a "direct-current component" or "d.c. component". Although usually amounting to just a few parts per thousand of the nominal transformer current, in the core of the transformer it produces a magnetic unidirectional flux that is superimposed on the primary or, as the case may be, secondary alternating flux and results in asymmetric adjusting of the B-H characteristic of the ferromagnetic core material. Because of the high permeability of the ferromagnetic core material, even a small unidirectional flux component can cause the core to be saturated and result in major distortions in the magnetizing current. The geostationary magnetic field can also contribute to a unidirectional flux component in the core. The consequences of said asymmetric adjusting are increased magnetic losses and hence increased heating of the core, as well as peaks in the magnetizing current that cause increased emission of operating noise.

The undesired saturation effect could basically be counteracted by making the magnetic circuit larger in cross-section and thereby keeping the magnetic flux density B smaller, or by providing a (substitute) air gap in the magnetic circuit as proposed in, for example, DE 198 54 902 A1. Since, however, the former approach will increase the transformer's structural volume and the latter will result in a greater magnetizing current, both approaches are disadvantageous.

To reduce the noise emission from an electrical transformer, U.S. Pat. No. 5,726,617 and DE 699 01 596 T2 each propose the use of actuators that excite the oil in a transformer housing such as to attenuate the fluid pressure waves emanating from the core stack and transformer windings while the transformer is operating. However, said actuators consume a not inconsiderable amount of energy during operation and are moreover interference-prone and costly.

DESCRIPTION OF THE INVENTION

An object of the present invention is to provide a transformer in the case of which heating of the core due to a magnetic unidirectional flux therein and the emission of noise will in as simple a manner as possible be lessened.

Said object is achieved by means of the features of the claims. Advantageous embodiments of the invention are defined in the dependent claims.

The invention proceeds from the notion not of combating the undesired effects of pre-magnetizing but of eliminating their cause. The inventive transformer is characterized as follows:

- The transformer has a soft-magnetic core on which, in addition to a primary and secondary winding arrangement, a compensation winding arrangement is arranged.
- The compensation winding arrangement is connected to a current control device that feeds a compensation current into the compensation winding arrangement in accordance with a control variable, which a magnetic field measuring device provides from a measurement of a flux that is interlinked with a current in the primary or secondary winding arrangement, in such a way that the effect of said compensation current in the core is in a direction opposite to a magnetic unidirectional flux.

What is achieved thereby is that a magnetic unidirectional flux component in the core of a transformer can be determined in a simple manner by measuring means and compensated using a corrective adjustment operation. Adjusting of the B-H characteristic will be symmetric once the unidirectional flux component has been eliminated. The core's ferromagnetic material will no longer be driven into saturation. The magnetostriction of the material will therefore be less, as a consequence of which the emission of operating noise will also be reduced. The transformer windings will be subjected to a lesser thermal load because the magnetic losses and hence the operating temperature in the core will be less.

The compensation current in the compensation winding is inventively defined in accordance with a magnetic field measurement variable supplied by a magnetic field measuring device. What are suitable for determining the magnetic field measurement variable are magnetic field sensors that are known per se and measure either the field in the core of the transformer or the stray magnetic field that closes outside the core via the air path. The fundamental working principle of said sensors can be, for example, induction in a measuring coil, the Hall effect, or the magneto-resistive effect. The magnetic field measurement variable can also be ascertained by using a magnetometer (fluxgate or Foerster probe). The metrological effort expended in ascertaining the magnetic field measurement variable is less compared with precisely measuring the direct-current component (which especially in the case of a large transformer is much smaller than the nominal current and therefore difficult to register).

A preferred embodiment of the invention can be characterized in that the magnetic field measuring device is formed from a signal processing unit that is connected in a signal-conducting manner to at least two magnetic field detectors. In the case of a three-phase transformer of conventional design it can suffice to determine two unidirectional flux components because the overall flux must balance out to zero.

The signal processing unit is advantageously set up for ascertaining overtones from in each case one measurement signal provided by the magnetic field detector and forming the control signal from said overtones. A control variable suitable for compensating the unidirectional flux component can be obtained thereby at comparatively little overhead in circuitry terms. Harmonic analysis can be performed electronically or with computer support.

What are therein especially suitable are even-numbered harmonics, in particular the first overtone (second harmonic) whose amplitude correlates functionally with the magnetic unidirectional flux requiring to be compensated.

What is particularly preferred is an embodiment variant in the case of which two magnetic field detectors are arranged outside the core in such a way as to register a stray flux of the transformer. The stray flux rises very sharply when the core is magnetically saturated, a factor that is favorable for ascertaining the control signal.

The magnetic field detector can be embodied simply as an induction probe that registers the change in stray flux and converts said change into an electrical measurement signal from which the even-numbered harmonics, in particular the second harmonic, can then be filtered out.

In a very particularly preferred embodiment variant the induction probe can be embodied as an air-cored coil. Compared with a semiconductor-based measuring transducer, the electrical measurement signal of said air-cored coil is independent of long-term and temperature drifting and is economical as well.

To minimize any effects of the power supply on the compensation winding, it can be favorable for a suppressor (for example a reactance dipole) to be connected in the current path to the current control device. The voltage burden of the controlled current source that feeds the compensation current into the compensation winding can be kept small thereby. What is suitable therefor is, for example, a two-terminal network that is formed from, for instance, a parallel LC circuit and suppresses the power supply frequency but scarcely constitutes any resistance in terms of the compensation direct current.

The simplest way to arrange the magnetic field detector spatially favorably is to experiment or perform a numeric field simulation. What is especially favorable is a measuring location at which the magnetic fields due to the primary and secondary load currents largely compensate each other. What is preferred is an arrangement wherein an air-cored coil is arranged in a gap, formed from an outer circumferential surface of a transformer limb and the concentrically enclosing compensation winding or, as the case may be, secondary winding, approximately at center limb height.

A preferred arrangement site for the compensation winding can be the yoke in a three-limb transformer or the return limb in a five-limb transformer; that will allow simple retrofitting of a compensation winding on an existing transformer.

BRIEF DESCRIPTION OF THE DRAWINGS

For further elucidating the invention, reference is made in the following part of the description to the drawings from which further advantageous embodiments, specifics, and developments of the invention can be deduced.

EMBODIMENT OF THE INVENTION

Figure 1:
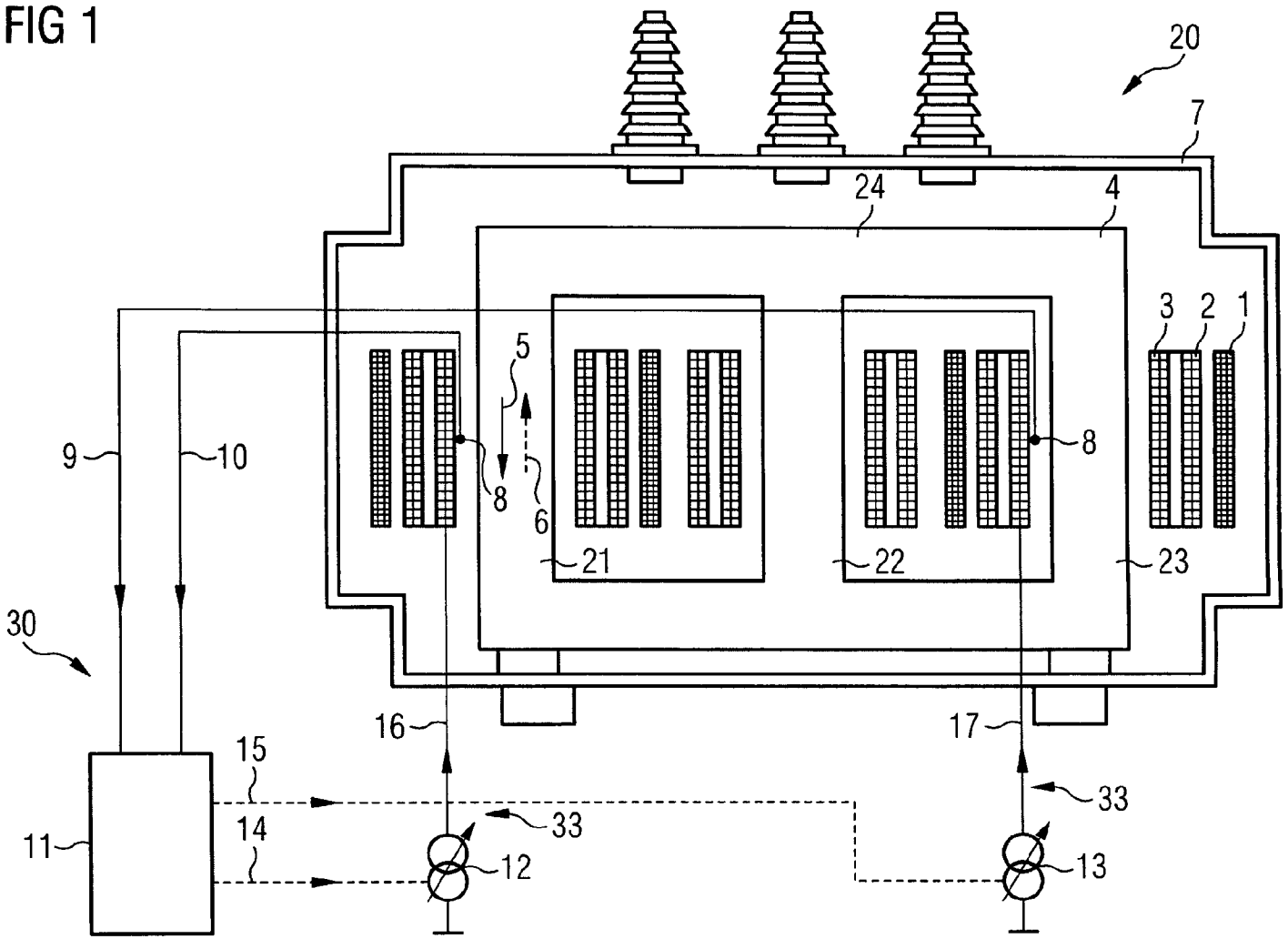
FIG. 1 shows an inventive three-phase transformer (three-limb transformer) that has unidirectional flux compensation and in the case of which the compensation-winding arrangement is arranged on the main limbs.

What can be seen in FIG. 1 is an electrical transformer 20 that has a housing 7 and a transformer core 4. The structural design of the core 4 corresponds to the three-limb structural design known per se having three limbs 21, 22, 23 and a transversal yoke 32. Located on each of the limbs 21, 22, 23 as is customary is a primary winding 1 and a secondary winding 2.

Inventively provided additionally on the outer limbs 21 and 23 is a compensation winding 3. A magnetic "unidirectional flux" is indicated by an arrow 5 in the drawing shown in FIG. 1 in the region of the first limb 21. Let it be assumed of said magnetic "unidirectional flux" 5 that it is caused by a "direct-current component" (d.c. component) flowing on the primary or secondary side. The "unidirectional flux" can, though, be due also to the earth's magnetic field. What is herein to be understood by "unidirectional flux" or "direct current" is a physical variable which, viewed temporally compared with 50-Hz alternating variables, varies only very slowly—if that is the case at all. Said magnetic unidirectional flux 5, which is superimposed on the alternating flux in the limb 21, causes pre-magnetizing that results in asymmetric adjusting of the magnetic material and hence in increased noise emission. Two controlled current sources 12 and 13 are provided in FIG. 1 for inventively compensating said unidirectional flux component. In each case with corrective adjusting as the purpose, a compensation current 16 or, as the case may be, 17, whose strength and direction are established such that the magnetic unidirectional flux 5 in the core 4 will be compensated, is fed by said current sources 12, 13 into an assigned compensation winding 3. (That is indicated in FIG. 1 by an arrow 6 the same size as the arrow 5 and pointing in the opposite direction thereto.) Said corrective adjusting is performed by means of the control signals 14, 15 that are fed as a manipulated variable to the current sources 12 or, as the case may be, 13 via the leads 9, 10.

The control variables 14, 15 are provided by a signal processing unit 11 explained in more detail further below. As can be seen from FIG. 1, located in each case approximately centrally between the compensation winding 3 and an outer limb 21 or, as the case may be, 23 of the core 4 is a magnetic field detector 8. Each of said magnetic field detectors 8 is located outside the magnetic circuit and measures a stray field of the transformer 20. Significantly prominent in the stray field is in particular the specific half-wave of the magnetizing current that is driven into saturation so that the unidirectional flux component in the core is readily ascertainable. The measurement signal of the detectors 8 is fed to the signal processing unit 11 via the leads 9, 10.

Each of the two magnetic field detectors 8 consists in the present instance of a measuring coil (several hundred turns, approximately 25 mm in diameter). As shown in the present example of a three-limb transformer, just two detectors 8 can suffice because the sum of the unidirectional flux components must balance out to zero across all limbs. As already mentioned above, basically a multiplicity of sensor principles can be considered for magnetic field measuring. What is decisive is only that a magnetic field characteristic of the transformer is measured from which the d.c. component or, as the case may be, unidirectional flux component can be ascertained by signal means and subsequently correctively adjusted.

Figure 2:
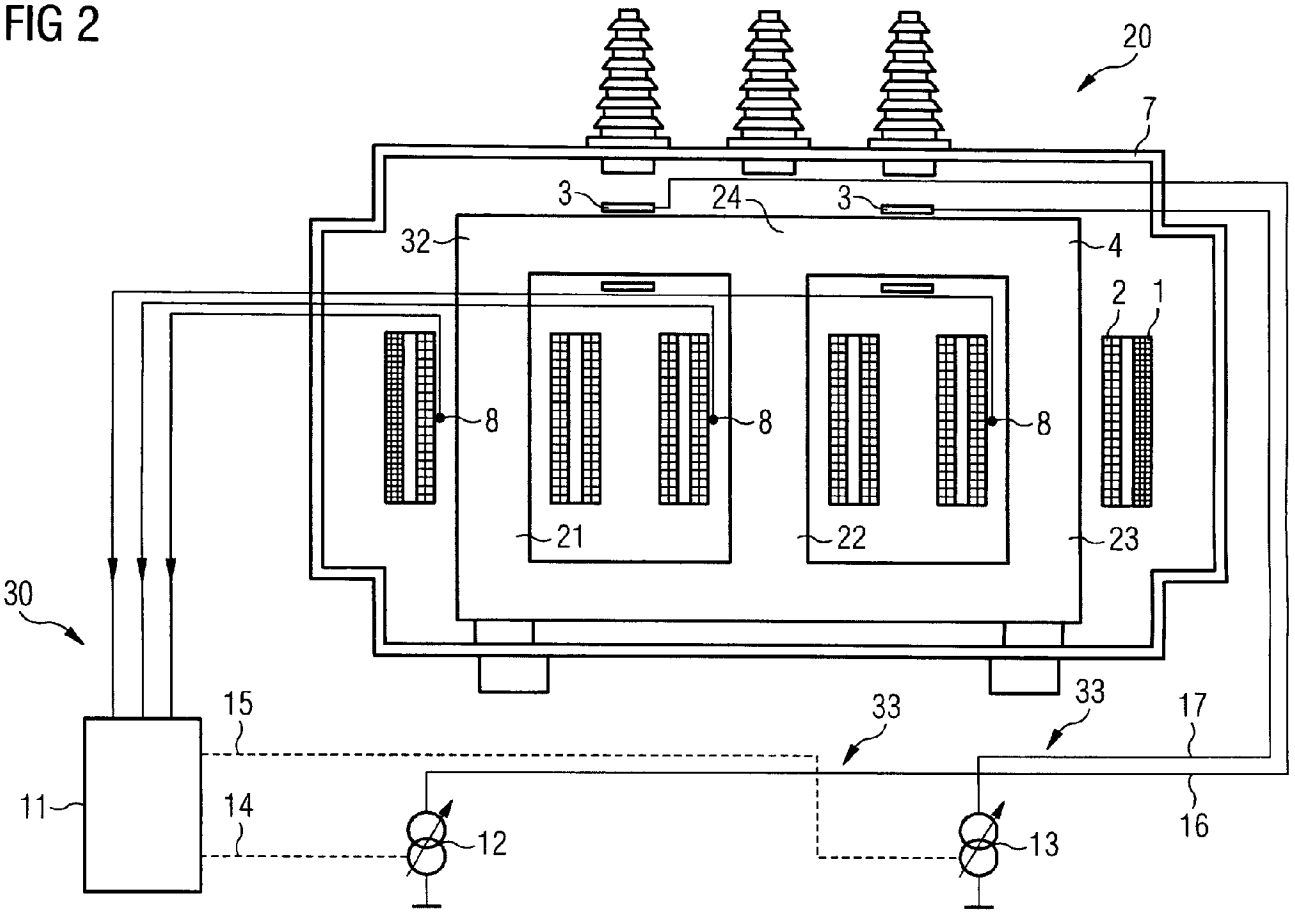
FIG. 2 shows an inventive three-phase transformer (three-limb transformer) that has unidirectional flux compensation and in the case of which the compensation-winding arrangement is arranged on the yoke.

FIG. 2 differs from FIG. 1 only in that the compensation winding arrangement 3 is arranged not on a main limb 21, 22, 23 but on the yoke 32 of the core 4. Arranged on each main limb 21, 22, 23 again in a gap between the core 4 and secondary winding 2 is a magnetic field detector 8 (in this case a total of three for reasons of redundancy).

Figure 3:
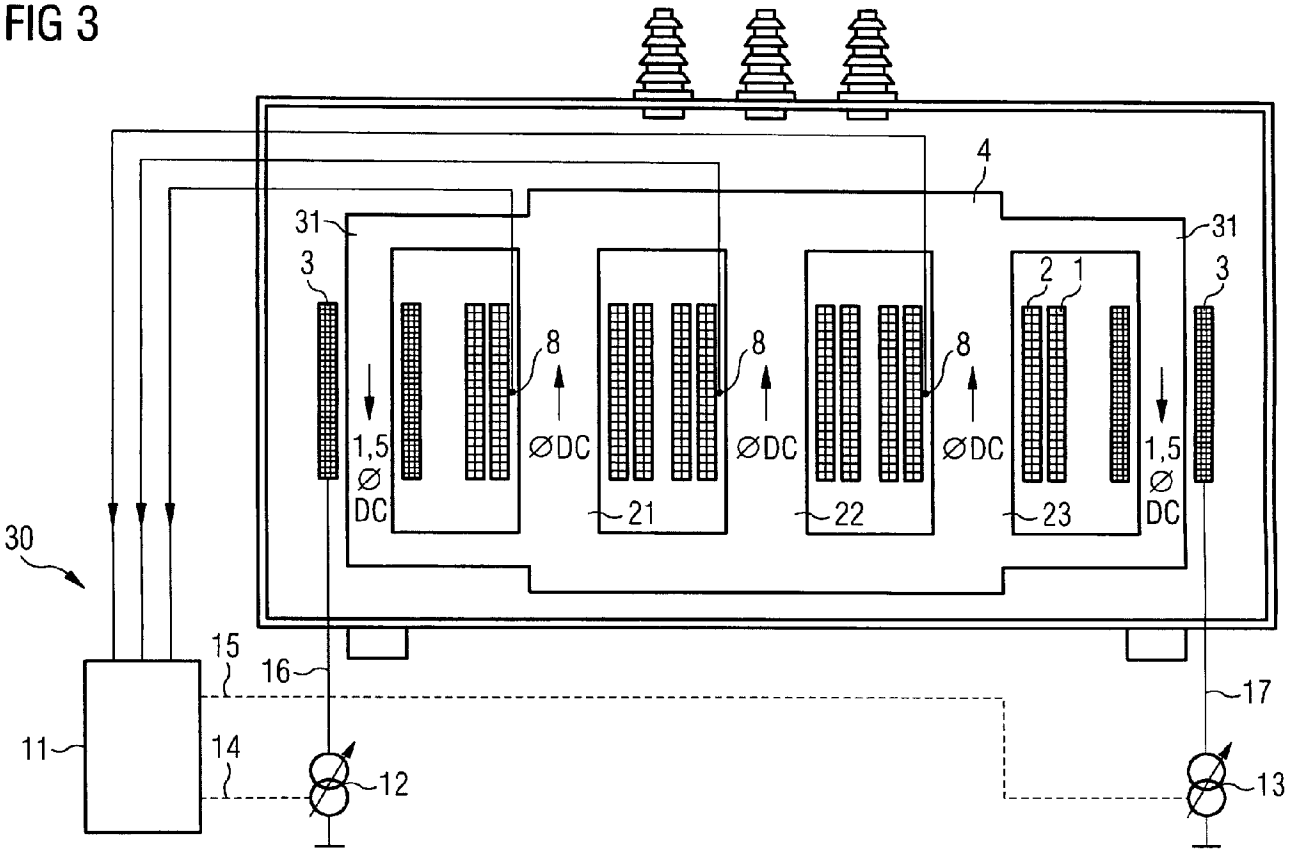
FIG. 3 shows an inventive three-phase transformer that has unidirectional flux compensation and in the case of which the compensation winding arrangement is located on a return yoke.

FIG. 3 shows a five-limb transformer in the case of which a compensation winding 3 is arranged on each return limb 31. With that design, the core flux does not divide in half along two sides upon entering the yoke; owing to the law of continuity, the unidirectional flux component respectively flowing back from the return limbs 31 must correspond to the unidirectional flux in the main limbs 21, 22, 23 so that each return limb 31 carries 1.5 times the unidirectional flux component. Each limb 21, 22, 23 is again assigned a magnetic field detector 8 arranged outside the core 4. Each measurement signal of said three magnetic field detectors 8 is again fed to the signal processing unit 11, which at its output side provides the control variables 14, 15 for the controlled current sources 12 and 13 so that the compensation current 16 or, as the case may be, 17 can compensate the unidirectional flux component in the return limbs 31.

Figure 4:
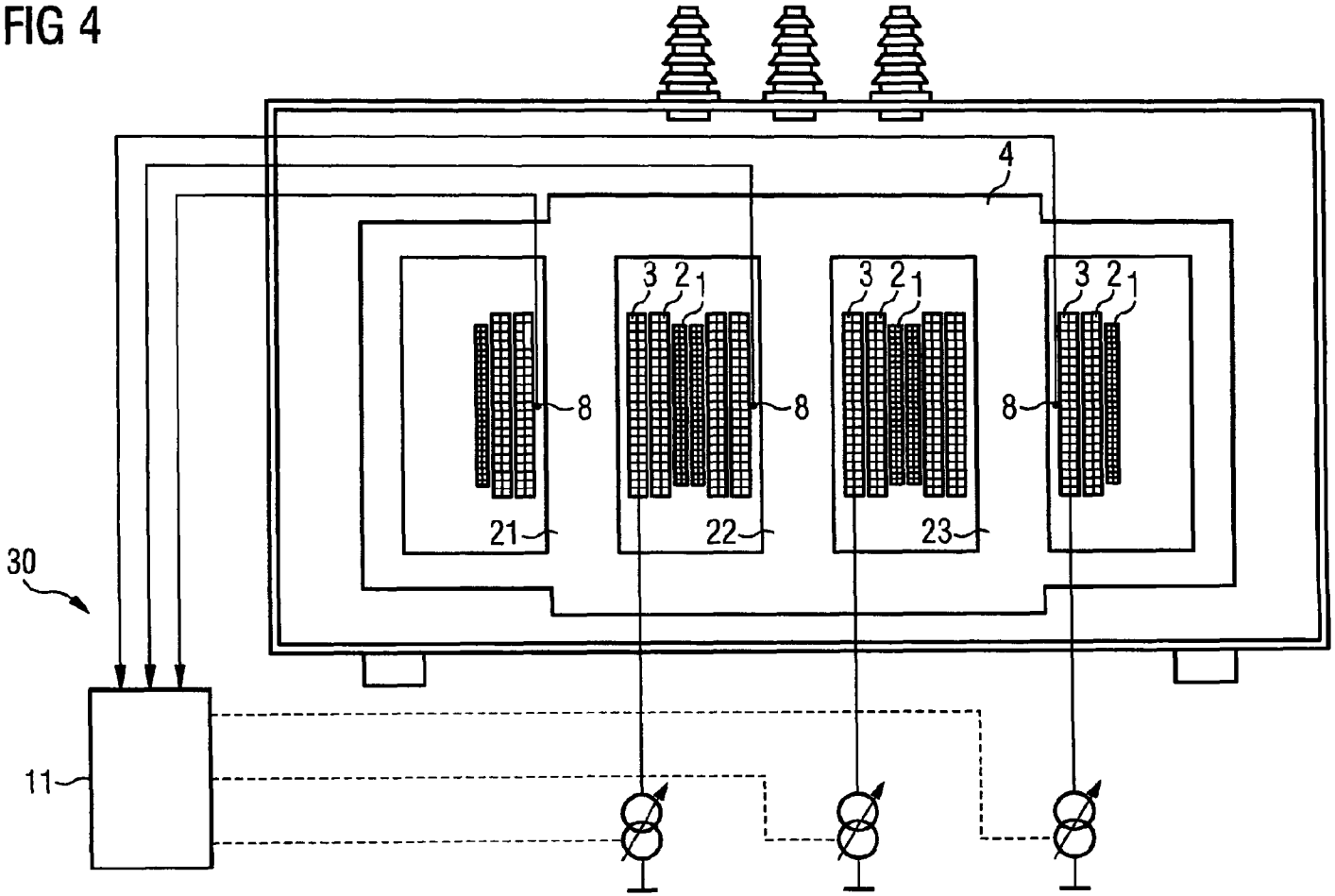
FIG. 4 shows an inventive three-phase transformer (five-limb transformer) that has unidirectional flux compensation and in the case of which the compensation-winding arrangement is located on the main limbs.

FIG. 4 shows a variant of the exemplary embodiment shown in FIG. 3. In this case the compensation windings 3 are located on the main limbs 21, 22, and 23. Each of said compensation windings 3 is again assigned one of three current control devices. The compensation current is defined as described above by the signal processing unit 11.

Figure 5:
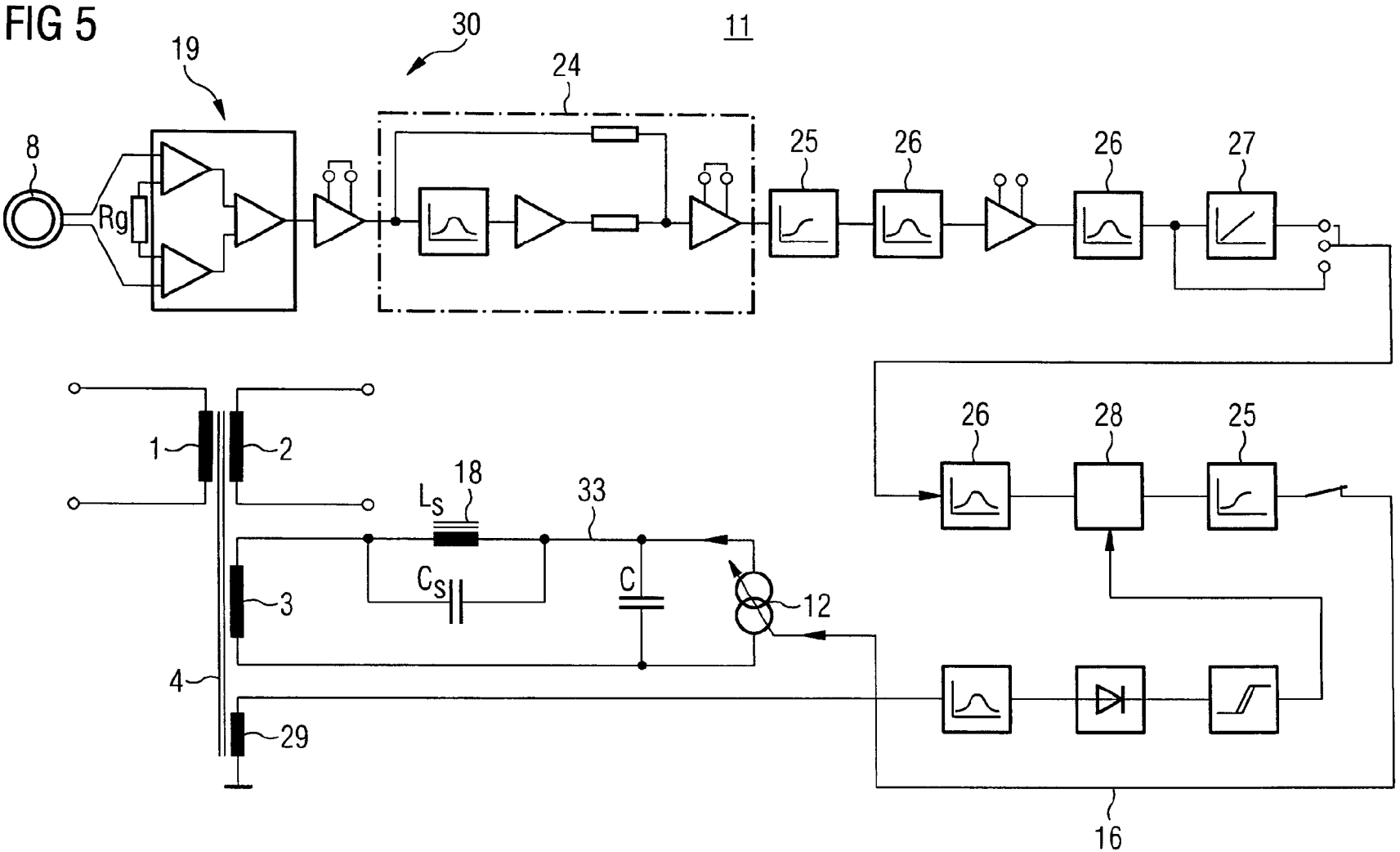
FIG. 5 is a block diagram of the inventive signal conditioning for compensating the unidirectional flux component.

FIG. 5 is a block diagram showing a possible embodiment variant of the signal processing unit 11 that functions as a d.c. cancellation controller. As already described above, the signal processing unit 11 ascertains the second harmonic, directly imaging the unidirectional flux component (d.c. component), from the spectrum of the overtones.

That is explained in more detail below with the aid of the function blocks shown: A sensor coil 8 registers a stray flux of the transformer 20. The measurement signal of the sensor coil 8 is fed to a difference amplifier 19. Following along the signal path shown, the output signal of the difference amplifier 19 reaches a notch filter 24 which filters out the fundamental component (50-Hz component). The measurement signal reaches an integrator 27 via a low-pass filter 25 and a band-pass filter 26. Integration produces a voltage signal that is proportional to the change in magnetic flux in the measuring coil 8 and is fed to a highly selective band-pass filter 26 in order to filter out the second harmonic that images the unidirectional flux component. After a sample-and-hold circuit 28 and low-pass filter 25, said voltage signal reaches the controlled current source 12 having an integrated regulating device via the lead 16. Said current source 12, along with its regulating device, is connected in a closed current circuit 33 to a compensation winding 3. In the compensation winding 3 it defines a direct current that opposes the unidirectional flux component in the core 4. Because the direction of the d.c. component requiring to be compensated is not known a priori, use is made of a bipolar current regulator, having in the present experiment IGBT transistors in a full bridge. An integrator 27 causes the phase to lag by 99 degrees with reference to the second harmonic. The reactance dipole 18, consisting of an anti-resonant circuit, blocks circuit feedback from the power frequency components.

What can further be seen in FIG. 5 is an auxiliary winding 29 whose signal is fed after filtering and rectifying to the sample-and-hold circuit 28. It serves in the circuit shown to condition the sampling signal so that phase-related sampling of the second harmonic of the measurement signal is possible. Let it be noted at this point that said sample-and-hold circuit in the end serves solely for phase-related sampling of the measurement signal (second harmonic 100 Hz) provided by the induction probe 8.

The signal conditioning presented in FIG. 5 is just an example of a possible method for measuring the second harmonic. A range of analog as well as digital function modules will be available for that purpose to a person skilled in the relevant art. For example the current control variable 14, 15 could be obtained also by means of a suitable digital computing method in a microcomputer or freely programmable logic chip (freely programmable gate array: FPGA) that determines the second harmonic (100 Hz) from the Fourier transformation.

Figure 6:
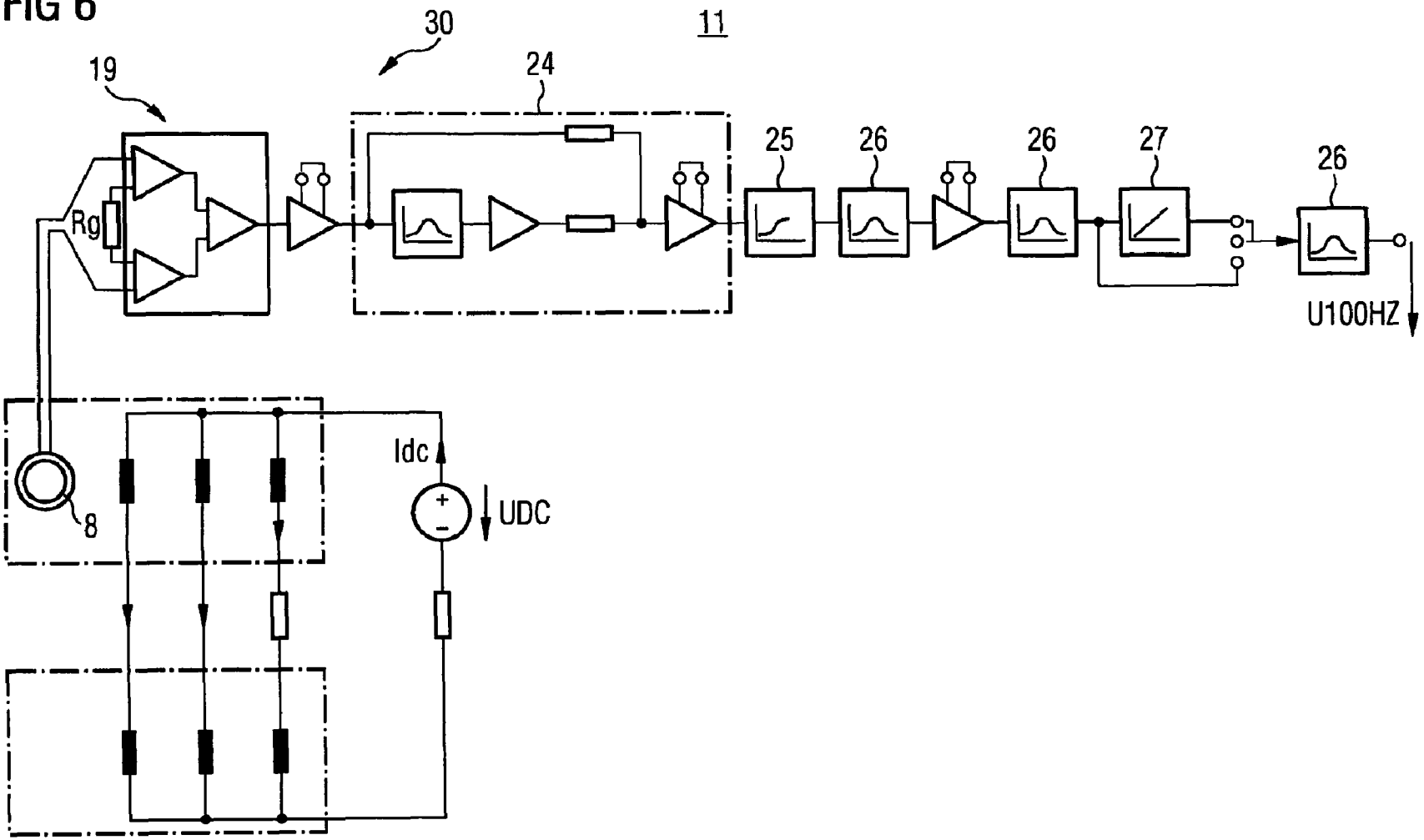
FIG. 6 is a block diagram of a measurement experiment for measuring the unidirectional flux component on a 4-MVA power transformer, with signal conditioning as shown in FIG. 5 being used.

FIG. 6 shows an experimental arrangement wherein the signal conditioning unit 11 shown in FIG. 5 and explained above is used with a 4-MVA power transformer for determining the correlation between the unidirectional flux component and first overtone (second harmonic) by measuring means under real conditions. In that experiment the 4-MVA power transformer was operating in open circuit with a primary voltage of 6 KV or, as the case may be, 30 KV. A d.c. component of between 0.2 and 2 A was fed in at the neutral points of the primary or, as the case may be, secondary winding arrangement (FIG. 6) by means of a current source. Serving as the magnetic field detector 8 was a sensor coil having 200 turns that was arranged externally on the core of the transformer and registered the stray flux.

Figure 7:
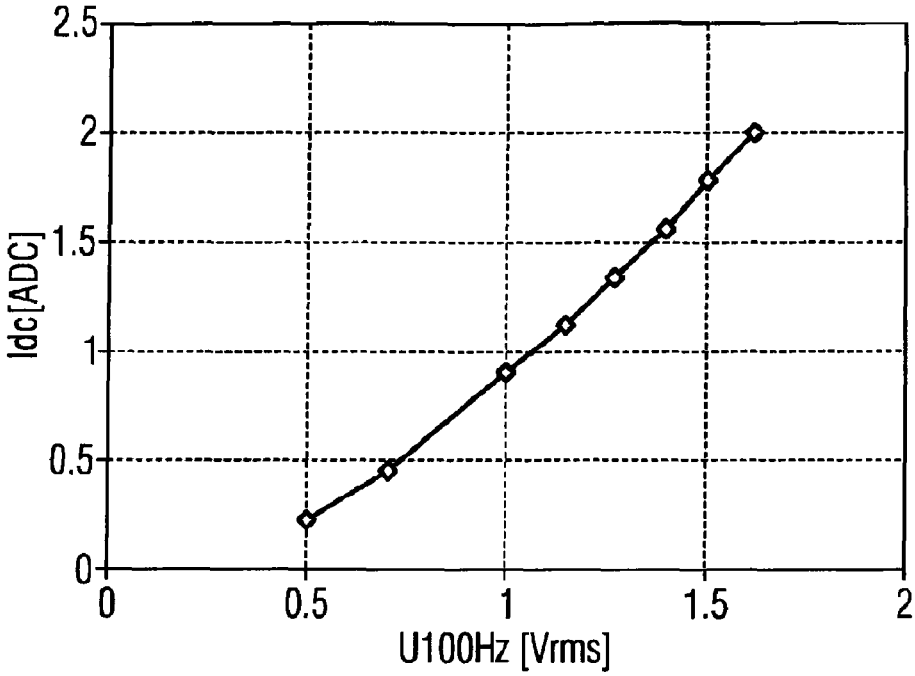
FIG. 7 is a graph showing as the result of the measurement experiment shown in FIG. 6 the linear corelation between the d.c. component and second harmonic with a primary voltage of 6 kV.
Figure 8:
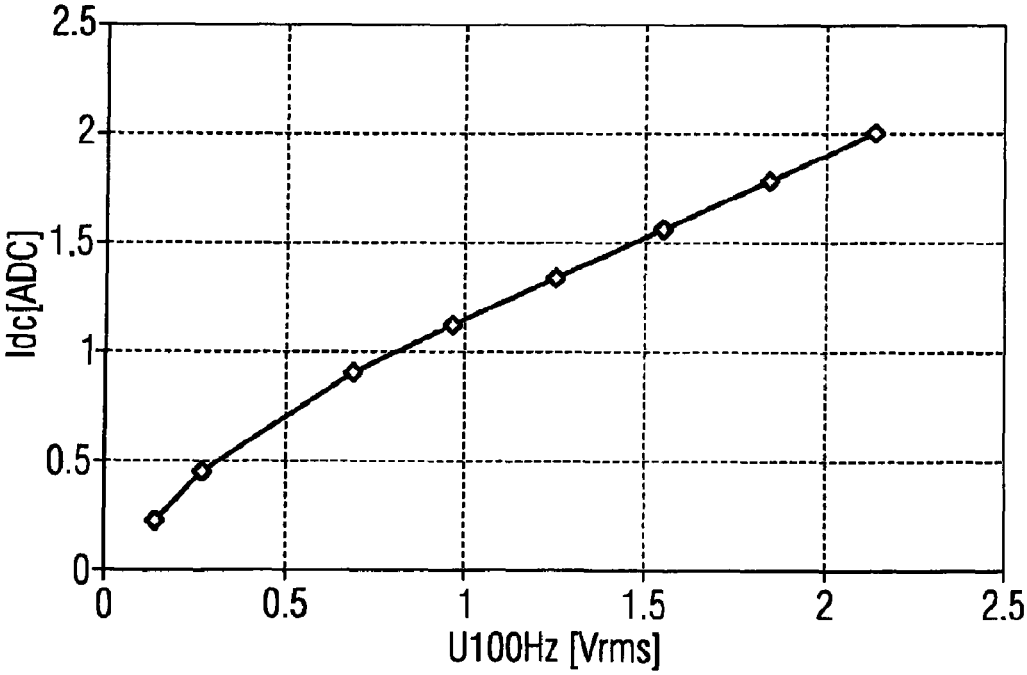
FIG. 8 is a graph showing as the result of the measurement experiment shown in FIG. 6 the linear corelation between the d.c. component and second harmonic with a primary voltage of 30 kV.

The result of the measurement performed on the experimental arrangement shown in FIG. 6 is logged in each case on a graph in FIGS. 7 and 8. The direct-current component (IDC) fed in at the neutral point is plotted on the ordinate in the graphs in FIGS. 7 and 8; the root-mean-square (rms) value of the first overtone (U100 Hz) is plotted on the abscissa. The graph in FIG. 7 shows the rms correlation for a primary voltage of 6 KV; the graph in FIG. 8 for a primary voltage of 30 KV. Both graphs in FIGS. 7 and 8 show that the correlation between the direct-current component (IDC) and the distortion associated therewith (second harmonic U100 Hz) can with reasonable accuracy be regarded as linear.

Overall, that means that the characteristic ascertained from a magnetic field measurement performed on a power transformer is highly suitable for forming a control variable capable of registering by measuring means and compensating a unidirectional flux component—irrespective of its cause, meaning even if the earth's magnetic field is involved—so that operating noise and heating of the transformer can be kept low.

The invention claimed is:

1. An electrical transformer with unidirectional flux compensation, comprising:

a transformer including a soft-magnetic core on which a primary winding arrangement, a secondary winding arrangement, and a compensation winding arrangement are arranged;

a magnetic field measuring device measuring a magnetic field in the soft-magnetic core of the transformer or a stray magnetic field that closes outside the core via an air path and provides a control signal;

a current control device connected via a current path which contains a reactance dipole to the compensation winding arrangement, the current control device feeds a compensation current into the compensation winding arrangement using the control signal in such a way that the effect of the compensation current in the core is in a direction opposite to a magnetic unidirectional flux, wherein the control signal is fed to the current control device, wherein the magnetic field measuring device includes a signal processing unit that is connected in a signal-conducting manner to at least two magnetic field detectors, wherein each magnetic field detector is arranged outside the core and register a stray flux of the transformer, wherein each magnetic field detector is embodied as an induction probe, wherein each induction probe is an air-cored coil, wherein the core includes three limbs, wherein at least two of the three limbs are fitted with a compensation winding, and wherein each air-cored coil is arranged in a gap, the gap formed from an outer circumferential surface and an enclosing compensation winding or the secondary winding, approximately at center limb height.

2. The transformer as claimed in claim 1, wherein the signal processing unit is set up to ascertain a plurality of overtones from a measurement signal provided by the magnetic field detector in such a way as to ascertain the control signal from the plurality of overtones in order to correctively adjust the magnetic unidirectional flux.

3. The transformer as claimed in claim 2, wherein the control signal is formed from a first overtone which is also known as a second harmonic.

4. The transformer as claimed in claim 1, wherein the reactance dipole includes an anti-resonant circuit.

* * * * *